US005362147A

United States Patent [19]

Schels et al.

[11] Patent Number: 5,362,147

[45] Date of Patent: Nov. 8, 1994

[54] METHOD AND APPARATUS FOR THE CONTACTLESS AUTOMATIC MIXING OF A REACTION MIXTURE IN AN ANALYSIS UNIT

[75] Inventors: Hans Schels, Munich; Horst Menzler, Bernried, both of Germany

[73] Assignee: Boehringer Mannheim GmbH, Mannheim, Germany

[21] Appl. No.: 123,994

[22] Filed: Sep. 21, 1993

[30] Foreign Application Priority Data

Sep. 25, 1992 [DE] Germany ..... 4232096

[51] Int. Cl.[5] ..... B01F 13/02

[52] U.S. Cl. ..... 366/107; 366/165; 366/169

[58] Field of Search ..... 366/101, 102, 106, 107, 366/165, 167, 169, 172, 173, 177, 178; 422/135, 224, 305

[56] References Cited

U.S. PATENT DOCUMENTS

| | | | |
|---|---|---|---|
| 3,398,935 | 8/1968 | Livesey et al. . | |
| 3,531,093 | 9/1970 | Karpacheva | 422/224 |
| 4,390,284 | 6/1983 | Hyde | 366/165 |
| 4,498,819 | 2/1985 | El-Saie | 366/165 |
| 4,664,526 | 5/1987 | Scheffler et al. . | |

FOREIGN PATENT DOCUMENTS

| | | |
|---|---|---|
| 12645/88 | 9/1988 | Australia . |
| 0176014 | 4/1987 | European Pat. Off. . |
| 0281958 | 9/1988 | European Pat. Off. . |
| WO85/03571 | 8/1985 | WIPO . |
| 8706618 | 11/1987 | WIPO . |

OTHER PUBLICATIONS

Patent Abstracts of Japan, vol. 13, No. 24, Jan. 19, 1989.

Patent Abstracts of Japan, vol. 7, No. 253, Nov. 10, 1983.

Patent Abstracts of Japan, vol. 7, No. 146, Jun. 25, 1983.

*Primary Examiner*—Robert W. Jenkins

*Attorney, Agent, or Firm*—Nikaido, Marmelstein, Murray & Oram

[57] ABSTRACT

Method for the contactless automatic mixing of a liquid reaction mixture in an analysis unit, in which the reaction mixture is located in a vessel accessible from above through an opening, by means of a gas jet escaping from an outlet opening of a mixing element, a rapid, effective and reliable non-invasive thorough mixing of the liquid is achieved by the mixing element being lowered at the start of the mixing operation in the direction of the liquid surface and the lowering movement being stopped in a bottom end position in which the mixing element projects into the vessel, but does not touch the liquid surface, the gas jet is switched on during the lowering of the mixing element, the gas jet is so aligned that it brings about an asymmetrical lowering of a part of the liquid surface in the vicinity of the vessel wall, and the gas jet has a rotational component of motion so that the lowered part of the liquid surface is set in rotation about the axis of the vessel.

19 Claims, 1 Drawing Sheet

Figures 1, 2, 3:
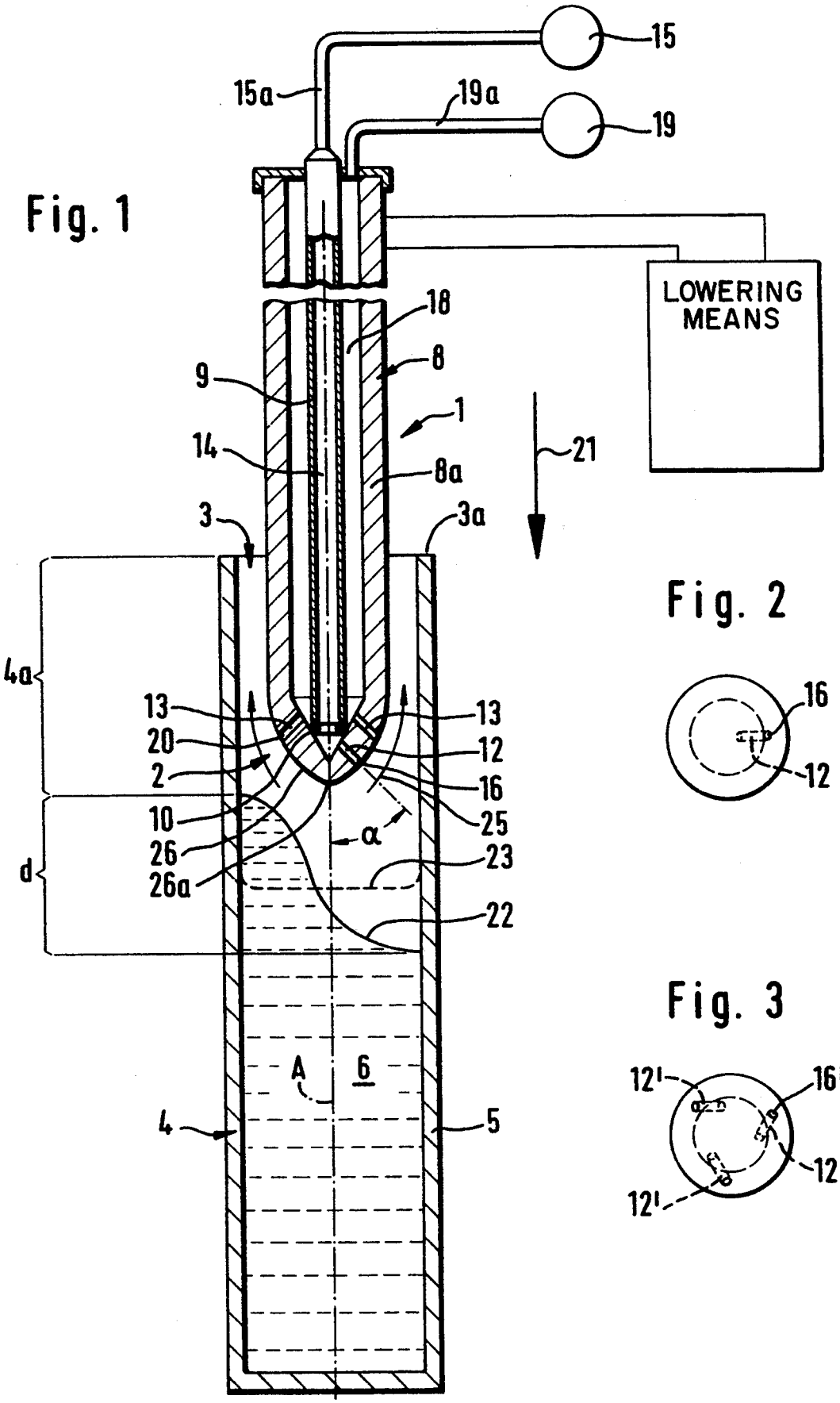

METHOD AND APPARATUS FOR THE CONTACTLESS AUTOMATIC MIXING OF A REACTION MIXTURE IN AN ANALYSIS UNIT

The invention relates to a method for the contactless automatic mixing of a liquid reaction mixture in an analysis unit and an apparatus for carrying out the method.

Analyses for medical purposes in which body fluids, in particular blood and urine, are tested for components contained therein (analytes) have been carried out for many years mainly with the aid of automatic analysis units. Not only is a cost reduction achieved in this way, compared with manual methods, but also improved reliability and accuracy of the results.

Many different types of automatic analysis unit have been developed. The present invention is suitable in particular for so-called discrete analysers, with which each individual analysis is carried out in a separate reaction vessel which as a rule is of round (in most cases circular) cross-section, is transported in a vertical position through various handling stations of the unit and is open in an upward direction. The reaction vessel is loaded under computer control with sample fluids and liquid reagents, the resulting reaction mixture is homogenised by means of a mixing device and after expiry of a predetermined reaction time, in many cases also after a multi-stage reaction in which several reagents are added successively, a physically detectable measured quantity resulting from the reaction of sample and reagents and characteristic of the analysis is obtained. This measured quantity can be for example a photometrically determinable absorbance, a fluorescence signal or an electrochemical measured quantity (voltage or current flow). The present invention is directed, independently of details of the method and of the measured quantity used for the determination, towards automatic analysis units of the most varied design, provided they call at any stage of the procedure for the mixing of a reaction mixture in an elongated vessel accessible from the top through an opening with a perpendicularly running longitudinal centre line.

The above-mentioned discrete automatic analysis units imitate to a large extent, by means of mechanical, hydraulic and electronic means, the handling steps known from manual analyses. It is not surprising, therefore, that automatic units of this type were among the first units used for automatic analysis. Although in the meantime numerous other types of automatic analysis unit have been developed, for example centrifugal analysers and continuous flow analysers, the discrete analysers have not declined in importance over the long term. They are instead on a present-day showing by far the most significant group of automatic analysis units. This success is attributable mainly to the fact that discrete automatic analysis units make a fully selective, sample-oriented method of operation possible, i.e. an individual sequence of different analytes can be determined successively for each sample.

One of the main problems which attended the development of discrete automatic analysis units from the start concerns the mixing of reaction mixtures in the reaction vessels. This task, which seems simple at first sight, proves to be difficult in detail, because a number of important requirements have to be fulfilled. In particular the mixing has to take place quickly and completely, in order to ensure a high rate of analysis and good accuracy. The accuracy is on the other hand influenced significantly if during the handling process, including the mixing, portions of foreign sample or reagent get into a reaction vessel in which they do not belong. This can occur in particular through transfer from ("invasive") stirring elements dipping into the reaction mixture.

In order to prevent this so-called "carry-over", proposals have already existed for a long time for effecting the mixing of the reaction mixture in a reaction vessel without contact with the reaction liquid (non-invasive). For example, cylinder-shaped reaction vessels with mixing elements fixed to their bottoms have been used, which have been rotated rapidly to and fro in the unit for the mixing. In another known unit the reaction vessel is exposed to ultrasonic waves in a liquid bath in order to achieve the required homogenisation.

It has also already been proposed that a gas jet directed onto the surface of the liquid in the vessel be used for the mixing. In WO 85/03571 use is made in conjunction with cuvettes of rectangular cross-section of an air jet which is directed from a stationary nozzle, through as low an angle as possible with respect to the liquid surface, onto the edge of the liquid surface, i.e. onto the meniscus at the boundary between liquid and vessel wall. Importance is attached to stationary and exact alignment of both the nozzle and the vessel during the mixing process, the jet being directed parallel with the longer dimension of the vessel cross-section. The nozzle is to be situated preferably outside the vessel. In a less preferable embodiment it is also envisaged that the nozzle be lowered into the vessel for the mixing operation. This is regarded as disadvantageous, however, because the throughput (i.e. the rate of analysis) of the unit is thereby reduced and the nozzle is contaminated by the liquid. The nozzle therefore has to be rinsed between the mixing operations in this embodiment.

In U.S. Pat. No. 3,398,935 (which was filed in 1964, i.e. in the initial stages of the development of automatic analysis units) a mixing method is described which is based on generating above the liquid surface a gas mass whirling in a circle, whose rotary motion is transferred to a low-viscosity fluid for mixing and brings about the mixing of the latter. Two practical realizations are described. FIG. 2 of the literature reference shows a gas pipe, directed against the wall of the vessel, which is evidently rotated in order to generate the desired whirling gas mass above the liquid surface. FIGS. 3 and 4 of the literature reference show an embodiment in which a gas jet is directed centrally onto the centre of the surface. The rotating gas whirl is produced here by the fact that the gas outlet ducts at the bottom end of the gas supply pipe run obliquely, so that a circulating component of motion of the gas jet results.

These proposals for automatic contactless mixing by means of a gas jet have not gained acceptance at the practical level. Despite the known advantages in principle of contactless mixing, to date use has been made almost exclusively in practice, for the homogenisation of the reaction mixture in automatic analysis units, of (invasive) mixing elements dipping into the liquid. The problem of carry-over is resolved where possible by washing of the mixing element between the individual mixing operations. The outlay in terms of labour and equipment is accepted as unavoidable.

The aim of the invention is to propose a method and an apparatus for the automatic mixing of a liquid reaction vessel in an analysis unit, which operates without contact (non-invasively) and at the same time makes rapid, effective and reliable mixing of the liquid possible.

The aim is achieved, in the case of a method in which the reaction mixture is located in a vessel accessible from above through an opening, by means of a gas jet escaping out of an outlet opening of a mixing element, in which the mixing element is lowered at the start of the mixing operation in the direction of the liquid surface and the lowering movement is stopped in a bottom end position in which the mixing element projects into the vessel but does not touch the liquid surface, the gas jet is in operation during the lowering of the mixing element, the gas jet is so aligned that it brings about an asymmetrical lowering of a part of the liquid surface in the vicinity of the vessel wall and the gas jet has a tangential component of motion, so that the lowered part of the liquid surface is set in rotation about the axis of the vessel. Air is with expediency used as the mixing gas on cost grounds.

The invention also has as its subject matter an apparatus for carrying out the method, in which at least one and at the most three gas jet outlet openings are provided in the vicinity of the bottom end of the mixing element, which are connected via a mixing gas pipe of the mixing element to a mixing gas source.

If the operating conditions according to the invention is adhered to, a rapid and thorough mixing of the reaction mixture is achieved, without the mixing element or the environment of the vessel being contaminated by the liquid. In order to avoid liquid splashes and the resulting risk of carry-over it is essential that the flow of the mixing gas is already activated during the lowering of the mixing element into its bottom end position. During the lowering of the mixing element it must remain constant or increase steadily up to a maximum value, which is then held constant.

The bottom end position, at which the mixing element is stopped, is selected so that the outlet opening of the gas jet is located below the edge of the opening of the reaction vessel, but on the other hand the bottom end of the mixing element does not touch the liquid surface. Said position may be determined empirically within these limits through a knowledge of the present invention. Distances of some 4 mm to 7 mm between the bottommost boundary of the mixing element and the liquid surface at rest with a vessel diameter of some 9 mm have proved effective in practice.

The gas jet has to impinge on the liquid surface offset radially with respect to the vessel axis, i.e. at a point between the vessel axis and the vessel wall. It does not have to be directed directly onto the liquid surface, but may also be directed onto the vessel wall at a low angle and impinge from there indirectly on the region of the liquid surface next to the wall. The jet of the mixing gas is so proportioned in its strength and spatial extension that it produces an asymmetrical lowering of a part of the liquid surface. The "strength" of the jet depends on the velocity of the gas molecules and their flow rate. These quantities are in turn dependent on the gas pressure in the pipe through which the mixing gas is supplied in the mixing element and on the dimensions of the nozzle through which it is directed onto the liquid surface. Finally, the movement of the molecules of the gas jet exhibits a rotational component of motion, i.e. a component of motion circulating about the longitudinal centre line of the vessel. A movement of the liquid in the reaction vessel is thereby obtained which is characteristic of the invention. The liquid is set rapidly in a circulating motion, liquid layers which lie beneath the asymmetrical lowering of the liquid surface also being set virtually without delay in a substantially horizontally circulating motion. The lower liquid regions in the central region of the circulation rise upwards spirally and thereby mix very rapidly with the upper liquid regions.

The selection of the point of impact of the gas jet on the liquid surface in the radial direction is critical here. The jet is preferably so directed that the radial distance from the wall of the lowest point of the asymmetrical lowering comes to less than 10% of the greatest vessel diameter.

The rotational component of motion of the gas jet may be achieved by rotating the mixing element with the outlet opening of the gas jet in the bottom end position (about an axis coaxial with the centre line of the vessel). According to an alternative preferred embodiment it may however also be generated by a corresponding alignment of the end section, which determines the jet direction, of the mixing gas line leading to the outlet opening. Said end section is described below as the nozzle. Said expression must not however be taken to mean that the end section of the pipe has to have a nozzle-shaped, conically tapering form. It may instead be cylindrical in form with a uniform cross-section.

The invention will be described in detail below by means of an exemplifying embodiment shown diagrammatically in the figures, where FIG. 1 shows a cross-sectional view of a mixing element lowered into a reaction vessel and located in the end position, FIG. 2 a view of a first embodiment of a mixing element from below and FIG. 3 a view according to FIG. 2 of an alternative embodiment of the mixing element.

The mixing element shown in FIG. 1 projects with its bottom end 2 into a circular cylinder-shaped reaction vessel 4, accessible from above through an opening 3, whose perpendicularly running longitudinal centre line is designated as A. A liquid 6 for mixing is located in the vessel 4.

The mixing element 1 consists mainly of two coaxial pipes, namely an outer pipe 8 and an inner pipe 9. The walls of the outer pipe 8 meet conically at the bottom end 2 of the mixing element 1, so that the mixing element is closed in a downward direction (apart from drillings provided in the wall 8*a* of the outer pipe 8, which serve as nozzles 12 and 13).

The bottom end of the inner pipe 9 is sealed at the annular contact line 10 to the inside of the wall 8*a* of the outer pipe 9, so that the interior of the pipe 9 is separated from the annular interspace between the pipe 9 and the pipe 8.

The inner pipe 9 serves as a mixing gas pipe 14 through which air is supplied from a mixing gas source 15 with an adjustable pressure and after passing through the nozzle 12 escapes through an outlet opening 16. The annular interspace between the pipes 8 and 9 forms a pipe 18 separated from the mixing gas pipe 14, said pipe 18 being connected to a gas source 19 in order to supply an additional gas flow which escapes from outlet openings 20 through the drillings 13 and—as will be explained in further detail—serves as an anti-splash gas. The gas sources 15, 19 and the connecting pipes 15*a*, 19*a* to the mixing element 1 are indicated only symbolically. Suitable connection techniques, including those for the case of a mixing element rotating about the perpendicular axis A, are familiar to the skilled person.

Mixing element 1 is connected to a mechanical means (not shown) for moving up and down as required. Such means are well known in the art of analysis instruments, e.g. for lowering and withdrawing pipeting tubes into and from vessels containing samples or reagents.

In order to homogenise the liquid 6 in the vessel 4, the mixing element 1 is moved vertically downwards according to the arrow 21 and lowered into the upper part of the vessel 4, so that at least the bottom end 2 projects into the vessel. The lowering movement is stopped in a defined bottom end position which is selected so that the outlet openings 16 and 20 are located below the edge 3*a* of the opening 3 and the mixing element 1 does not touch the surface of the liquid 6. During the lowering operation mixing gas is already being supplied through the pipe 14 and preferably also anti-splash gas through the pipe 18 and is escaping through the outlet openings 16 and 20.

It is furthermore essential for the operation that the gas jet is so aligned that an asymmetrical lowering of a part of the liquid surface is brought about. In the figure this lowered shape of the liquid surface 22 is shown as a continuous line, while the rest position of the liquid surface is shown in dashes as line 23.

It is also important for the mixing effect according to the invention that the gas jet escaping out of the outlet opening 16 has a rotational component with respect to the longitudinal centre line A of the vessel 4, in the preferred case of a round vessel cross-section, therefore, a component tangential to the wall 5 of the vessel 4. As mentioned, this may be realized in two ways. On the one hand the nozzle 12, from which the mixing gas jet escapes, may be positioned radially (i.e. without a component of direction tangential to the vessel wall). Such an embodiment is shown in FIG. 2. In this case the tangential component of the gas jet motion is produced by rotation of the mixing element 1 about the axis A. The rotation frequency should preferably be between 10 and 80 revolutions per minute, ideally between 20 and 30 revolutions per minute.

Another possibility for generating the tangential component consists in the last section of the mixing gas pipe, which determines the direction of the gas jet, having a component of direction tangential to a circle around the longitudinal centre line A of the vessel. Such an embodiment is shown in FIG. 3.

The embodiments according to FIG. 2 and FIG. 3 also differ inasmuch as in the case of FIG. 2 only one outlet opening 16 is provided for the gas jet, while FIG. 3 exhibits three nozzles 12' positioned obliquely with a tangential component of direction with outlet openings 16'. The number of gas jet outlet openings preferably lies between 1 and 3 independently of the orientation of the nozzles.

In the embodiment according to FIG. 3 the mixing effect occurs without the mixing element 1 being rotated, but the two measures may naturally also be combined, i.e. a mixing element with gas outlet openings in accordance with FIG. 3 may additionally be set in rotation.

The movement of the liquid 6 during the mixing operation is characterised by the fact that on the one hand the liquid surface 22 is lowered asymmetrically to a relatively high degree and that on the other said lowering of the liquid surface is converted into a motion of rotation. The difference d between the highest point of the liquid surface and the deepest point of its lowered part preferably comes to at least 25%, particularly preferably at least 50%, of the diameter of the liquid surface (in the case of a non-circular cross-section, of its greatest diameter). The lowering naturally depends on the flow rate of the gas jet, the gas pressure in the pipe 14 and the diameter of the at least one gas jet outlet opening. The has flow preferably lies between 10 ml/s and 70 ml/s, particularly preferably between 20 ml/s and 60 ml/s. The diameter of the gas jet outlet openings 16 should preferably be between 0.1 and 0.8 mm, particularly preferably between 0.5 and 0.7 mm. The gas pressure is preferably between 1.2 bar and 1.7 bar. The nozzles are preferably aligned at an angle $\alpha$ of between about 30° and about 60° with respect to the axis A, an angle of about 45° having proved particularly effective.

At the bottom end 2, projecting into the vessel 4, of the mixing element 1 there are provided above the outlet openings 16 the additional outlet openings 20, through which a second gas flow is supplied as anti-splash gas. The mixing element preferably comprises at least four such outlet openings 20, which form a ring distributed uniformly over the periphery of the mixing element 1.

Also critical for a good mixing effect and for reducing the risk that the mixing element 1 will be contaminated by splashes from the liquid 6 during the mixing operation is the shape of the bottom end 2 of the mixing element 1 in relation to the cross-section of the vessel 4 (in the latter's upper region 4*a*, into which the mixing element 1 projects).

The greatest horizontal cross-sectional area of the part of the mixing element 1 which projects into the vessel 4 in the bottom end position should amount to at least 30% of the corresponding horizontal cross-sectional area (measured at the same vertical height) of the vessel. It should be noted here that the cross-sectional area to which this statement refers is related quadratically to the linear dimensions of the components. In the case of circular cross-sections, for example, a ratio of the diameters of the mixing element 1 and the vessel 4 of 0.6:1 corresponds to a cross-sectional ratio of 0.36:1. In other words the cross-section of the mixing element 1 must to a relatively large extent fill up the vessel 4, at least over part of its height, so that only a considerably reduced cross-section is available for the back flow of gas according to the arrows 25 past the mixing element 1. The gas is thereby retained below the mixing element 1 to a certain extent.

In order to reduce the risk of contaminations, it is in addition advantageous if the bottom boundary area 26 runs obliquely outwards and upwards from a deepest point 26*a* as shown. By bottom boundary area there must be understood here the area terminating the mixing element 1 in a downward direction, i.e. the surface of the mixing element 1 below the latter's greatest cross-section dipping into the vessel 4.

We claim:

1. A method for contactless automatic mixing of a liquid reaction mixture in an analysis unit, said method comprising the steps of:

providing the liquid reaction mixture in a vessel having an opening at an upper portion thereof;

providing a mixing element having at least one outlet opening therein, with a gas jet escaping from said outlet opening;

lowering the mixing element through the opening in the vessel toward a surface of the liquid, until a bottom end of the mixing element projects into the vessel, but does not touch the surface of the liquid, wherein said outlet opening of said mixing element is configured so that the gas jet escaping therefrom asymmetrically lowers a portion of the liquid such that a portion of the surface of the liquid adjacent a vessel wall is lowered to form a depression having a deepest point, and wherein said gas jet includes a rotational component of motion, such that the deepest point of the depression moves laterally along the vessel wall about a longitudinal center line of the vessel.

2. A method according to claim 1, wherein said gas jet escapes from said mixing element while said bottom end of said mixing element is being lowered through said opening of said vessel to project thereinto.

3. A method according to claim 1, wherein a flow rate of the gas jet is between 10 ml/s and 70 ml/s.

4. A method according to claim 3, wherein said flow rate is between 20 ml/s and 60 ml/s.

5. A method according to claim 1, wherein said gas jet is directed from said mixing element at an angle of 30° to 60° from a longitudinal center line of the vessel.

6. A method according to claim 1, wherein said step of lowering said mixing element is performed such that a distance of said deepest point of said depression from the vessel wall is less than 20% of a maximum diameter of the surface to the liquid.

7. A method according to claim 1, wherein a depth of the deepest point of the depression is lower than a corresponding highest point of the liquid surface by at least 25% of a greatest diameter of the liquid surface.

8. A method according to claim 1, wherein a depth of the deepest point of the depression is lower than a corresponding highest point of the liquid surface by at least 50% of a greatest diameter of the liquid surface.

9. A method according to claim 1, further comprising the step of rotating the mixing element in the vessel around an axis which is coaxial with a longitudinal center line of the vessel.

10. A method according to claim 9, wherein a rotating speed of the mixing element is between 10 and 80 revolutions per minute.

11. A method according to claim 9, wherein the rotating speed of the mixing element is between 20 and 30 revolutions per minute.

12. An apparatus for contactless automatic mixing of a liquid reaction mixture, said apparatus comprising:

a vessel with liquid reaction mixture therein, said vessel having an opening at an upper portion thereof;

a mixing element having a mixing outlet opening therein;

mixing gas supplying means coupled to said mixing element for supplying a mixing gas jet thereto, said mixing gas jet escaping from said mixing outlet opening in said mixing element;

means for lowering the mixing element through the opening in the vessel toward a surface of the liquid, until a bottom of the mixing element projects into the vessel, but does not touch the surface of the liquid, wherein said outlet opening of said mixing element is configured so that the mixing gas jet escaping from said outlet opening asymmetrically lowers a portion of the liquid such that a portion of the liquid surface adjacent a wall of the vessel is lowered, and wherein said mixing gas jet includes a rotational component of motion, such that the lowered portion of the liquid moves laterally along the vessel wall.

13. An apparatus according to claim 12, comprising no more than three mixing outlet openings in said mixing element.

14. An apparatus according to claim 13, wherein a diameter of each mixing outlet opening is between 0.1 and 0.8 mm.

15. An apparatus according to claim 14, wherein the diameter of each mixing outlet opening is between 0.5 and 0.7 mm.

16. An apparatus according to claim 12, further comprising at least one anti-splash outlet opening at a position above said at least one mixing outlet opening, said anti-splash outlet opening coupled to an anti-splash gas source and providing an anti-splash gas jet therefrom.

17. An apparatus as recited in claim 16, wherein said at least one mixing outlet opening is connected to said mixing gas supply means through a first axial pipe in said mixing element, and said at least one additional outlet opening is connected to said anti-splash gas source through a second pipe which is coaxial to said first pipe.

18. An apparatus as recited in claim 12, wherein a horizontal cross-sectional area of the bottom end of the mixing element which projects into the vessel is at least 30% of a corresponding horizontal cross-sectional area of the vessel.

19. An apparatus for contactless automatic mixing of a liquid reaction mixture in an analysis vessel, said apparatus comprising:

a liquid reaction vessel having an opening in an upper portion thereof;

a mixing element configured for insertion into said opening in said vessel, said mixing element comprising:

an outer pipe having an upper end and a lower end, said upper end being connected to a first gas source, and said lower end having at least one first outlet opening therein, said at least one first outlet opening providing a first gas jet from said first gas source, said outer pipe having an outer diameter which is less than a diameter of said aperture of said vessel;

an inner pipe disposed coaxially with said outer pipe, said inner pipe having an upper end which is coupled to a second gas source, and said lower end having an opening therein, said opening in said lower end of said inner pipe being in communication with at least one second outlet opening in said lower portion of said outer pipe, said at least one second outlet opening providing a second gas jet with gas provided by said second gas supply source;

wherein said mixing element is configured to be lowered into said liquid reaction vessel through the opening in the vessel toward a surface of a liquid reaction mixture therein, such that one of said first and second gas jets lowers a portion of the liquid such that a portion of the surface of the liquid adjacent a vessel wall is lowered, and wherein said one of said first and second gas jets includes a rotational component of motion, such that the lowered portion of the liquid moves laterally along the vessel wall, and wherein the other of said first and second gas jets acts as an anti-splash gas jet.

* * * * *